US008997717B2

(12) United States Patent
Roseborsky et al.

(10) Patent No.: US 8,997,717 B2
(45) Date of Patent: Apr. 7, 2015

(54) INTEGRATED FUEL INJECTOR ORIENTATION AND RETENTION DEVICE

(75) Inventors: Steven R. Roseborsky, Kingsville (CA); Dhyana Ramamurthy, Novi, MI (US)

(73) Assignees: DENSO International America, Inc., Southfield, MI (US); Denso Corporation, Kariya-shi, Aichi-ken ( * ) Notice: Subject to any disclaimer, the term of this patent is extended or adjusted under 35 U.S.C. 154(b) by 688 days.

(21) Appl. No.: 12/731,688

(22) Filed: Mar. 25, 2010

(65) Prior Publication Data

US 2011/0232609 A1 Sep. 29, 2011

(51) Int. Cl.
*F02M 61/14* (2006.01)

(52) U.S. Cl.
CPC ..... *F02M 61/14* (2013.01)

(58) Field of Classification Search
CPC ... F02M 47/027; F02M 55/025; F02M 61/14; F02M 61/166; F02M 69/047; F02M 69/465; F02M 2051/05; F16L 21/03; F16L 37/144; F16L 37/0987
USPC ..... 123/467–472, 456; 239/397.5; 285/305, 285/374, 921
See application file for complete search history.

(56) References Cited

U.S. PATENT DOCUMENTS

| | | | | |
|---|---|---|---|---|
| 5,674,245 | A * | 10/1997 | Ilgen | 606/212 |
| 5,921,967 | A * | 7/1999 | Sadowski et al. | 604/218 |
| 6,457,456 | B1 | 10/2002 | Scollard et al. | |
| 7,497,477 | B2 * | 3/2009 | Pepe | 285/93 |
| 2007/0113828 | A1 * | 5/2007 | Fonville et al. | 123/470 |
| 2009/0056674 | A1 * | 3/2009 | Furst et al. | 123/470 |
| 2009/0156063 | A1 * | 6/2009 | DeSaint et al. | 439/688 |
| 2010/0154746 | A1 * | 6/2010 | Fischer et al. | 123/456 |

FOREIGN PATENT DOCUMENTS

| | | |
|---|---|---|
| EP | 1892408 | 2/2008 |
| EP | 1892408 A1 * | 2/2008 |

OTHER PUBLICATIONS

Office Action issued Nov. 23, 2012 in corresponding German Application No. 102011001465.9 with English translation.

* cited by examiner

*Primary Examiner* — Johnny H. Hoang
(74) *Attorney, Agent, or Firm* — Harness Dickey & Pierce, P.L.C.

(57) ABSTRACT

Attaching a fuel injector to a common rail may utilize a fuel injector and an integral tab that has a solid head portion from which a first flexible prong and a second flexible prong protrude and define a gap therebetween. A fuel injector cup may define a notch through which the first prong and the second prong reside to secure the fuel injector to the fuel injector cup, which is attached to the rail. A first prong interior straight wall surface and a second prong interior straight wall surface may face the gap and be parallel. The prongs may define entry contact surfaces and exit contact surfaces that meet at prescribed angles to aid in insertion and hinder retraction of the injector tab from the injector cup. The tab defines a solid head portion below the gap that resides in the notch.

19 Claims, 8 Drawing Sheets

FIG 1
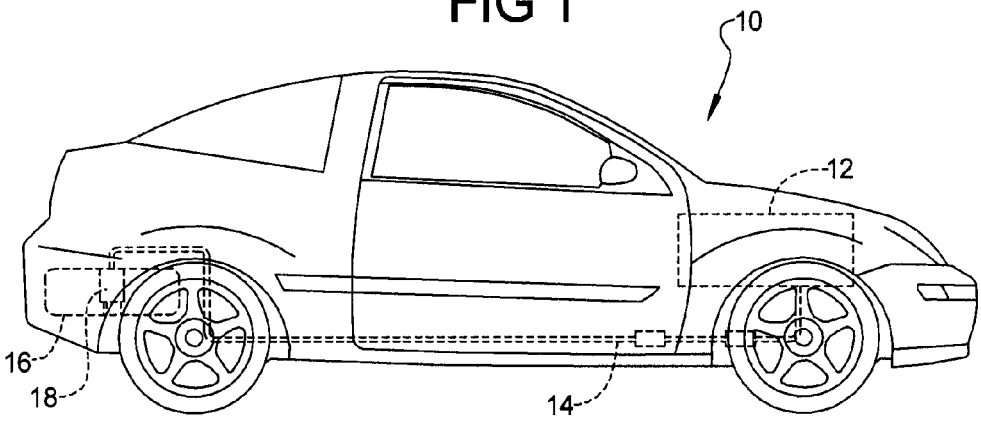
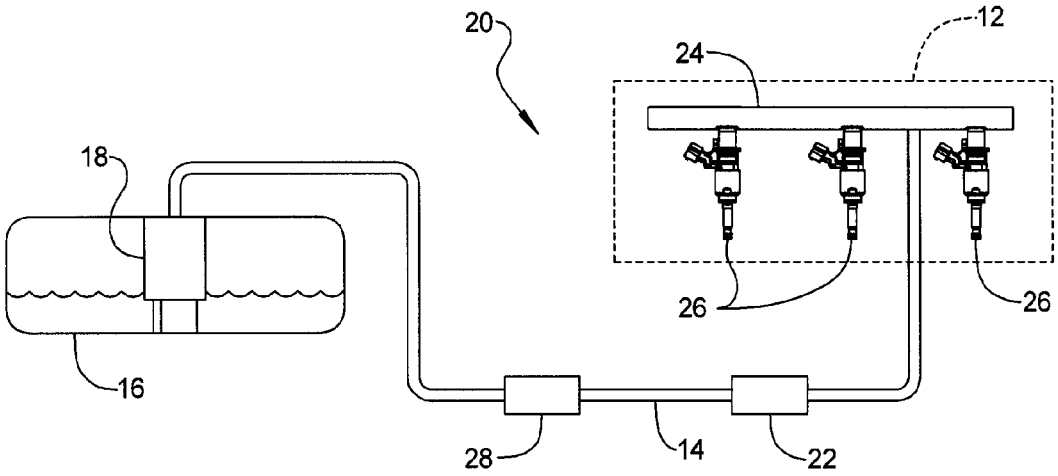
FIG 2

INTEGRATED FUEL INJECTOR ORIENTATION AND RETENTION DEVICE

FIELD

The present disclosure relates to a structure to aid in orientation and retention of a fuel injector to a fuel rail.

BACKGROUND

This section provides background information related to the present disclosure which is not necessarily prior art. Internal combustion engines such as direct injection engines may employ fuel injectors that provide a fluid conduit between a pressurized fuel rail and a combustion cylinder of an internal combustion engine. While current fuel injectors and corresponding fuel rails have been satisfactory for their given applications, such components are not without need for improvement.

Engine assemblers desire a tight, secure and aligned assembly of the fuel injector to the fuel rail to prevent disassembly during part shipment and during installation of the fuel rail and fuel injectors onto the engine. Additionally, prevention of a fuel injector from becoming misaligned with the fuel rail during assembly onto an engine or prior to assembly onto an engine or during engine operation is also desired. Typically, a fuel rail will employ a fuel injector cup that is brazed, welded or otherwise secured to a fuel rail. An injector may reside within the injector cup with the aid of a compressed O-ring, which resides over the injector inlet. During shipment of fuel injectors or during assembly of a fuel rail and an injector combination onto an engine, because only an O-ring is compressed against an interior of the injector cup, the integrity of the holding force of the compressed O-ring may be compromised, resulting in parting of the injector from the injector cup or misalignment of the parts prior to installation onto an engine. Moreover, during operation, fuel injectors may become stuck or seized onto the engine cylinder head due to soot or carbon build-up at the tip of the injector. In such a case, it is desirable to have the rail and injector separate easily. Thus, during servicing of a fuel injection system, service technicians desire a relatively quick disconnect of the fuel injector from adjacent components.

What is needed then is a device that quickly permits alignment and secure connection of a fuel injector with an injector cup and injector rail but that also permits quick and easy separation of the fuel injector from an injector cup.

SUMMARY

This section provides a general summary of the disclosure, and is not a comprehensive disclosure of its full scope or all of its features. An apparatus to secure a fuel injector to an engine's common fuel rail may employ a fuel injector, a fuel injector cup, and an orientation tab integral with the fuel injector. The tab may attach to the fuel injector cup to secure the fuel injector to the fuel injector cup, which is brazed or welded to the common fuel rail. The fuel injector cup may further define a flange that defines a notch with the tab protruding through the notch to secure the fuel injector to the fuel injector cup. Upon securing the tab, the fuel injector also becomes aligned with the fuel rail, which may be attached to the fuel injector cup. The tab may employ a flexible first prong and a flexible second prong such that the first prong and the second prong protrude through the notch to secure the tab to the flange. The first prong and the second prong define a gap therebetween. The first prong may further exhibit a first prong interior straight wall surface that faces the gap and the second prong may further exhibit a second prong interior straight wall surface that faces the gap. The first prong interior straight wall surface and the second prong interior straight wall surface may be parallel. The first prong may also exhibit a first entry contact surface and a first exit contact surface that meet to form an apex, and the second prong may further exhibit a second entry contact surface and a second exit contact surface that meet to form an apex.

The tab may define a solid head portion below the gap, the solid head portion may be bounded by a first outside wall with a surface and a second outside wall with a surface; the surfaces may be parallel. The solid head portion may reside in the notch such that only a solid portion of head portion resides in the notch; this eliminates flexing of the head and prongs when bounding parallel walls of the solid head portion contact structure defining the notch. The first entry contact surface and the first prong interior straight wall surface form a first angle that is less than a second angle formed by the first exit contact surface (extended) and the first sidewall surface of the first outside wall.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a side view of a vehicle depicting, in phantom, portions of a fuel system;

FIG. 2 is a schematic of a vehicle fuel supply system depicting fuel injectors, a fuel injection pump and a fuel pump module within a fuel tank;

Corresponding reference numerals indicate corresponding parts throughout the several views of the drawings.

DETAILED DESCRIPTION

Figure 3:
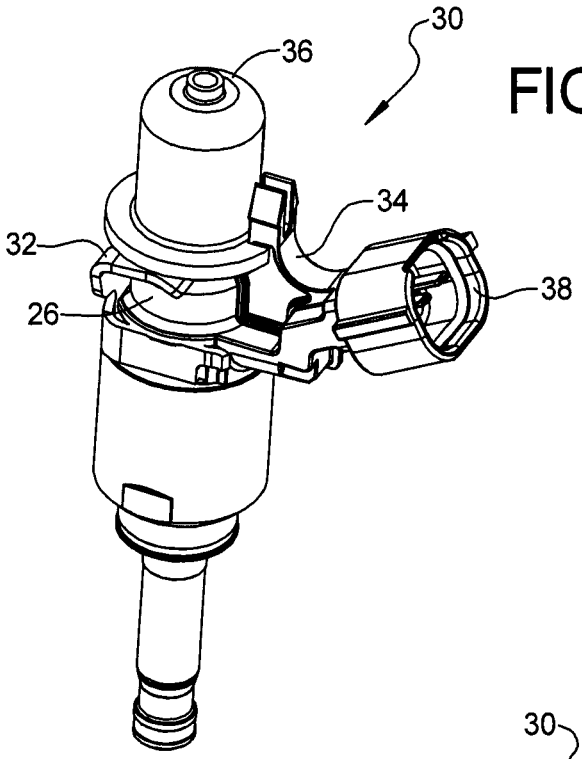
FIG. 3 is a perspective view of a fuel injector, a fuel injector cup, a fuel injector spring tab, and a fuel injector alignment tab in accordance with the present disclosure.

Example embodiments will now be described more fully with reference to the accompanying drawings. The following description is merely exemplary in nature and is not intended to limit the present disclosure, application, or uses. When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-17, a device that retains a fuel injector to a fuel injector cup and aligns a fuel injector to a fuel rail will be disclosed. FIG. 1 depicts a vehicle 10, such as an automobile, having an engine 12, a fuel supply line 14, a fuel tank 16, and a fuel pump module 18. Fuel pump module 18 resides within fuel tank 16 and may be submerged in or surrounded by varying volumes of liquid fuel when fuel tank 16 possesses liquid fuel. For purposes of explanation of the present disclosure, the liquid fuel may be considered gasoline since the present disclosure will be explained in the context of a fuel supply system 20 that employs a fuel injection pump 22, which may be employed to pressurize fuel rail 24 of engine 12. However, it is to be understood that the present disclosure may be adaptable to a vehicle employing diesel, or other liquid fuel. Fuel pump module 18 may be employed to supply liquid fuel to engine 12 through fuel supply line 14. FIG. 2 depicts fuel supply system 20 in which one or more fuel injectors 26 may be installed in engine 12 to receive fuel from a fuel injector common rail 24. Fuel supply system 20 may be either a return or a returnless fuel system. To reach a fuel pressure that is high enough to increase the efficiency of combustion, fuel may be pressurized by a fuel injection pump 22 before fuel reaches common rail 24. To ensure that fuel is clean enough to pass through fuel injection pump 22 and then fuel injectors 26, fuel may pass through a fuel filter 28 resident in fuel supply line 14.

Before continuing with a description of the present teachings, the primary focus will be on a single fuel injector, a single fuel injector cup, and a single fuel injector alignment tab because each fuel injector 26 in an engine 12 with multiple fuel injectors 26 may have the same arrangement or structure. Turning now to FIG. 3, an enlarged perspective view of fuel injector 26 is depicted along with an injector cup.

Figure 4:
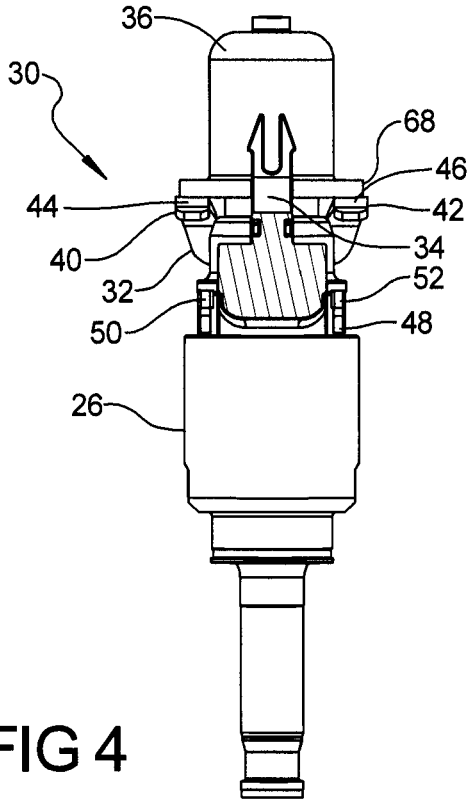
FIG. 4 is a side view of a fuel injector, a fuel injector cup, a fuel injector spring tab, and a fuel injector alignment tab in accordance with the present disclosure.

Continuing, FIGS. 3 and 4 depict a side view of a fuel injector assembly 30, which may include fuel injector 26, a fuel injector spring tab 32, a fuel injector alignment tab 34 and a fuel injector cup 36. An electrical plug 38 is a part of fuel injector 26 and provides a location where an electrical connection from a vehicle wiring harness interfaces with fuel injector 26. As depicted, fuel injector spring tab 32 may have a first spring prong 40 and a second spring prong 42 that each reside around a side of fuel injector 26. Spring prongs 40, 42 are flexible and move in an upward and downward motion that is parallel to an axis of fuel injector 26. First spring prong 40 has a first top surface 44 while second spring prong 42 has a second top surface 46 such that top surfaces 44, 46 provide a surface for fuel injector cup 36 or a flange 68 of fuel injector cup 36 to contact and bias prongs 40, 42. A spring tab base 48 also has a first base prong 50 and a second base prong 52 that reside on opposing sides of fuel injector 26 to clamp to fuel injector 26 and form a press fit or interference fit with fuel injector 26.

Figure 5:
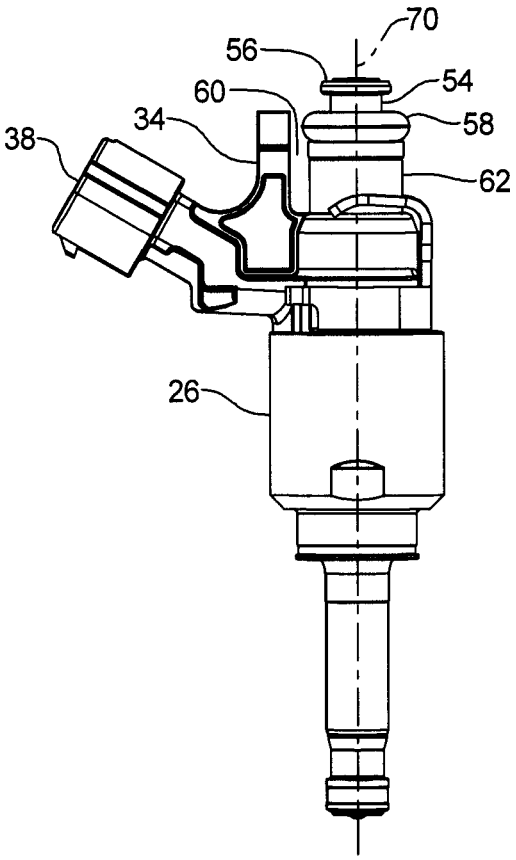
FIG. 5 is a side view of a fuel injector with a fuel injector tab in accordance with the present disclosure.

Turning to FIG. 5, fuel injector 26 is depicted equipped with fuel injector alignment tab 34, parallel to a longitudinal axis 70 of fuel injector 26. Secured over injector inlet 56 of fuel injector 26 is an O-ring 58. Before proceeding with additional structural details of fuel injector assembly 30, potential construction materials of the various parts of fuel injector assembly 30 will be discussed. Fuel injector 26, fuel injector spring tab 32 and fuel injector cup 36 may be made of stainless steel, while electrical plug 38 and fuel injector alignment tab 34 may be made of a heat resistant plastic, for example, while O-ring 58 may be made of a heat resistant rubber. FIG. 5 also depicts a gap 60 that is located between and defined by fuel injector alignment tab 34 and body 62 of fuel injector 26. Gap 60 exists for insertion of a sidewall of fuel injector cup 36, as will be explained later.

Figure 6:
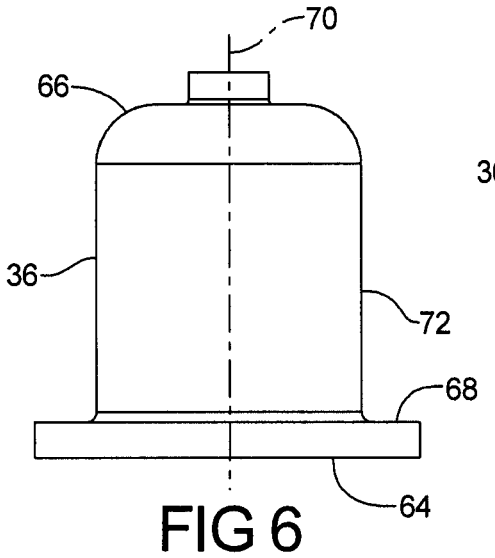
FIG. 6 is a side view of the fuel injector cup in accordance with the present disclosure.
Figure 7:
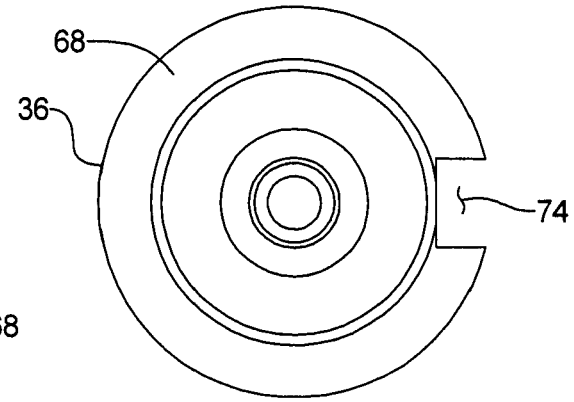
FIG. 7 is a top view of the fuel injector cup in accordance with the present disclosure.

FIGS. 6 and 7 depict views of fuel injector cup 36 which is a cover having an open end 64 and a rounded end 66 that is open to a lesser degree. Rounded end 66 has a hole through which fuel is received from fuel rail 24 before such fuel passes into fuel injector 26. Fuel injector cup 36 may have a flange 68 that may protrude at ninety degrees from a longitudinal axis 70 of fuel injector cup 36. Longitudinal axis 70 may be common to fuel injector 26 and fuel injector cup 36. Fuel injector cup 36 may be hollow to accommodate fuel injector inlet 56 and O-ring 58, which may be located around injector inlet 56. As depicted in FIG. 7, flange 68 may define a notch 74 for part of a depth of flange 68 or an entire depth of flange 68 to permit unobstructed access directly to sidewall 72 of fuel injector cup 36.

Figure 8:
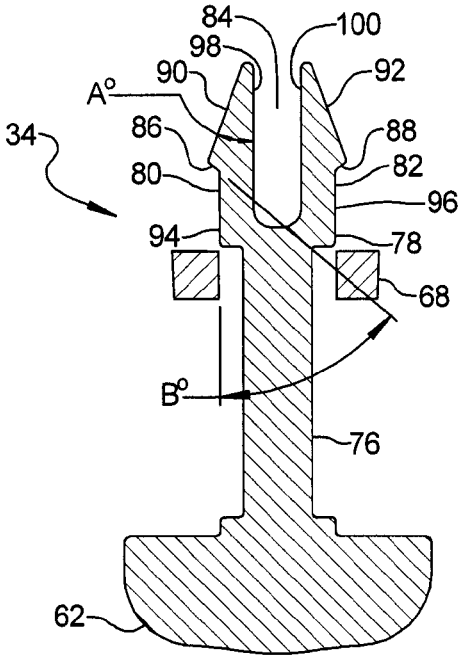
FIG. 8 is a is a cross-sectional view of the fuel injector alignment tab in accordance with the present disclosure.

Turning now to FIG. 8, enlarged cross-sectional view of fuel injector alignment tab 34 depicts an alignment tab column 76 protruding from body 62 of fuel injector 26. In cross section, alignment tab column 76 widens to a tab head 78 that defines a first alignment tab prong 80 and a second alignment tab prong 82. Between first alignment tab prong 80 and second alignment tab prong 82, a prong gap 84 is defined. Alignment tab prongs 80, 82 are mirror images of each other and each exhibits a retention feature that operates in conjunction with flange 68 of fuel injector cup 36. Alignment tab prongs 80, 82 may each be dual angle prongs and each may have dual contact surfaces that may contact flange 68, such as for insertion and removal of fuel injector alignment tab 34. More specifically, first alignment tab prong 80 may have a contact surface 86 and second alignment tab prong 82 may have contact surface 88, which is a mirror image of contact surface 86. Contact surfaces 86, 88 may be considered removal surfaces since contact surfaces 86, 88 contact flange 68 upon removal of fuel injector alignment tab 34 through notch 74 of flange 68. Continuing, a removal angle "B" may be formed between surface 86 (i.e surface 86 extended into tab) and sidewall 94 of tab head 78. The same angle as angle "B" may be formed between surface 88 (i.e surface 88 extended into tab) and sidewall surface 96 of tab head 78.

First alignment tab prong 80 may have a contact surface 90 and second alignment tab prong 82 may have contact surface 92, which is a mirror image of contact surface 90. Contact surfaces 90, 92 may be considered insertion surfaces since contact surfaces 90, 92 contact flange 68 upon insertion of fuel injector alignment tab 34 into or through notch 74 of flange 68. Continuing, an insertion angle or entry angle "A" may be formed between surface 90 and interior surface 98 that faces gap 84 of tab head 78. The same angle as angle "A" may be formed between surface 92 and interior surface 100 that faces gap 84 of tab head 78. Angle "A" which is an entry angle, may be smaller than angle "B," which is a removal angle. Angle "A" ensures ease of insertion during alignment of injector 26 with fuel rail 24 while angle "B" ensures an ease of removal of injector 26 from flange 68 of fuel injector cup 36 for servicing; however, due to angle "B" being a larger angle, removal requires more force than insertion.

Figure 9:
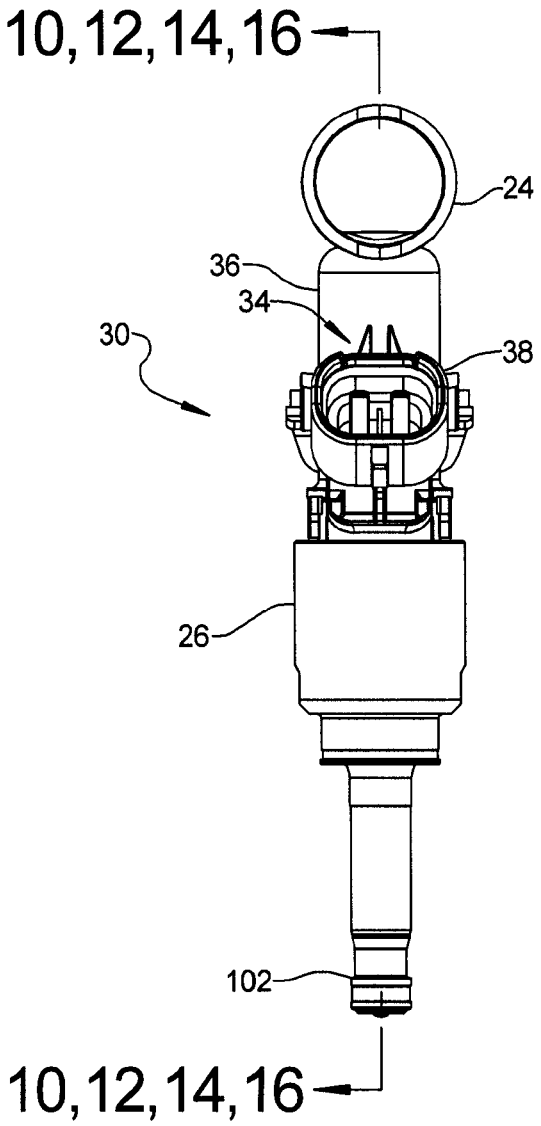
FIG. 9 is a side view of the fuel injector with a fuel injector alignment tab in accordance with the present disclosure.
Figure 10:
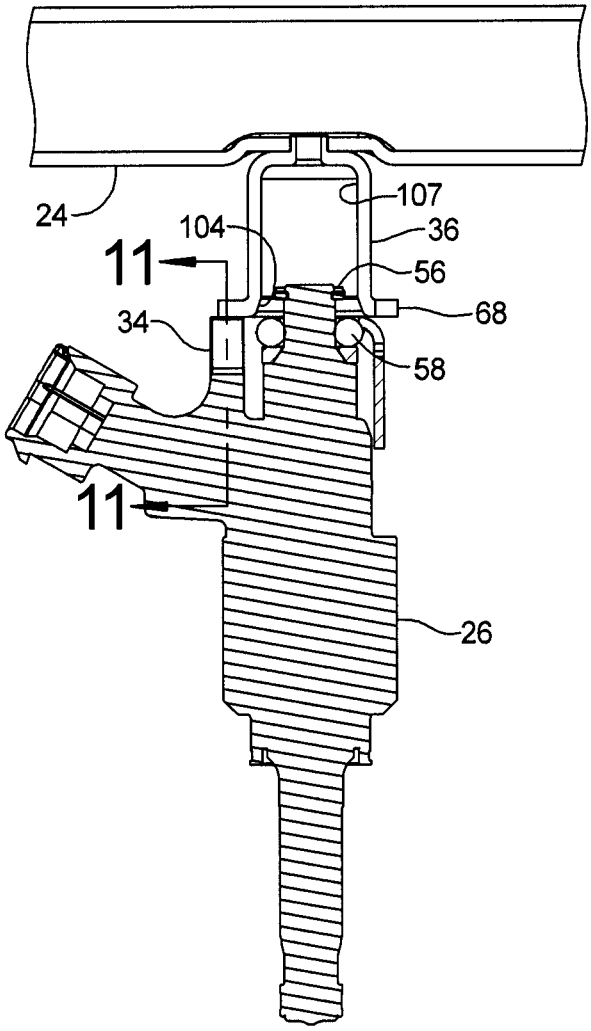
FIG. 10 is a cross sectional view of the fuel injector, fuel injector cup and fuel injector alignment tab in accordance with the present disclosure.
Figure 11:
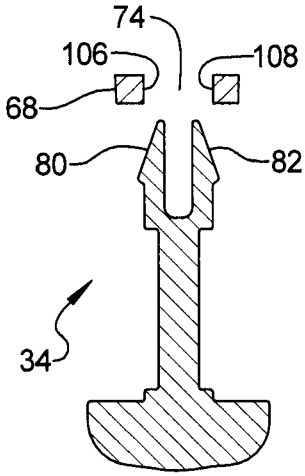
FIG. 11 is a cross sectional view of the fuel injector alignment tab relative to the fuel injector cup.

Turning now to FIGS. 9-17, additional details of fuel injector assembly 30 will be presented. FIG. 9 depicts a side view of fuel injector 26 including fuel injector cup 36 attached (e.g. brazed) to fuel rail 24. In FIG. 9, fuel injector cup 36 is mounted or clipped onto fuel injector alignment tab 34, which may be plastic and overmolded directly to fuel injector 26. A fuel injector exit tip 102 may be placed directly into an engine combustion chamber when in use. Turning now to FIGS. 10 and 11, a first position of fuel injector 26 relative to fuel injector cup 36 will be explained. FIG. 10 depicts injector inlet 56 of injector 26 slightly beyond entrance 104 of fuel injector cup 36. That is, injector inlet 56 is slightly within fuel injector cup 36. When injector 26 is in the position depicted in FIG. 10, fuel injector alignment tab 34 is at the position depicted in FIG. 11; thus, first and second alignment prongs 80, 82 of fuel injector alignment tab 34 have not yet entered into notch 74 in flange 68 of fuel injector cup 36. Similarly, O-ring 58 has not yet entered into an interior of fuel injector cup 36.

Figure 12:
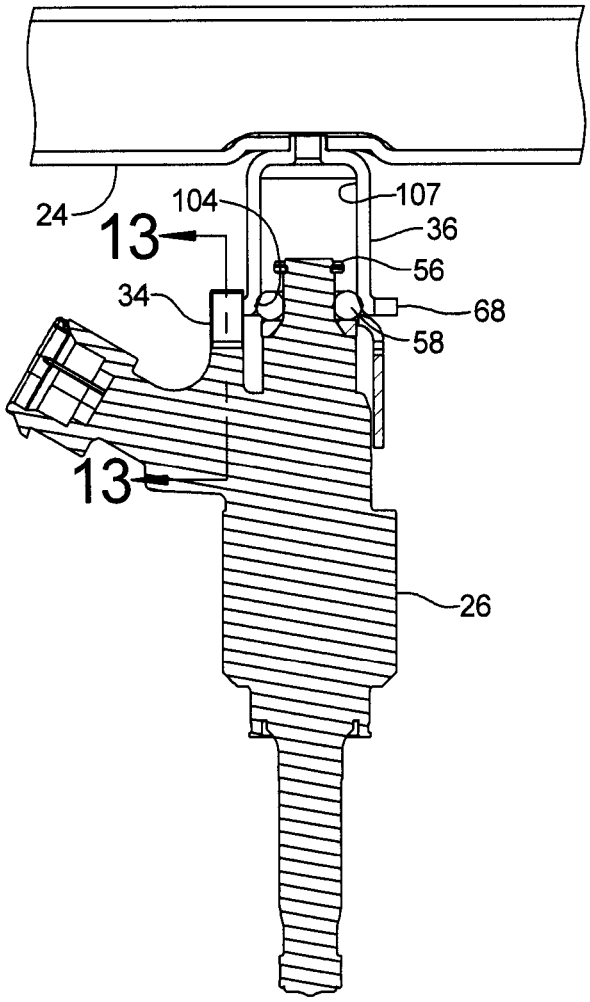
FIG. 12 is a cross sectional view of the fuel injector, fuel injector cup and fuel injector alignment tab in accordance with the present disclosure.
Figure 13:
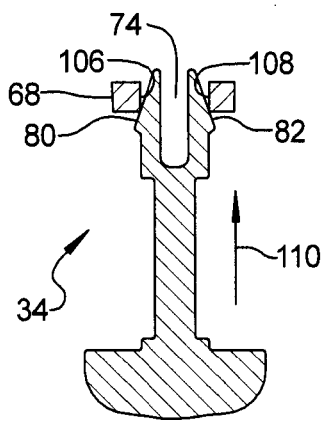
FIG. 13 is a cross sectional view of the fuel injector alignment tab relative to the fuel injector cup.

Turning now to FIGS. 12 and 13, FIG. 12 depicts injector inlet 56 within entrance 104 of fuel injector cup 36 such that O-ring 58 contacts interior sidewall 107 of fuel injector cup 36. More specifically, O-ring 58 contacts interior wall 107 adjacent or beside flange 68. When injector 26 is in the position depicted in FIG. 12, fuel injector alignment tab 34 is at the position depicted in FIG. 13. Thus, first and second alignment prongs 80, 82 of fuel injector alignment tab 34 have entered into gap or notch 74 in flange 68 of fuel injector cup 36. More specifically, upon first and second alignment prongs 80, 82 contacting a first flange sidewall 106 and a second flange sidewall 108 during insertion in a direction indicated by arrow 110, first and second alignment prongs 80, 82 begin to converge or move toward each other because prongs 80, 82 may be made from a flexible, plastic material. Additionally, because first and second alignment prongs 80, 82 have angled surfaces that contact flange 68, the insertion force necessary to compress prongs 80, 82 upon contact with flange 68 is reduced over prongs with a greater contact angle which would require a greater insertion force in direction depicted by arrow 110.

Figure 14:
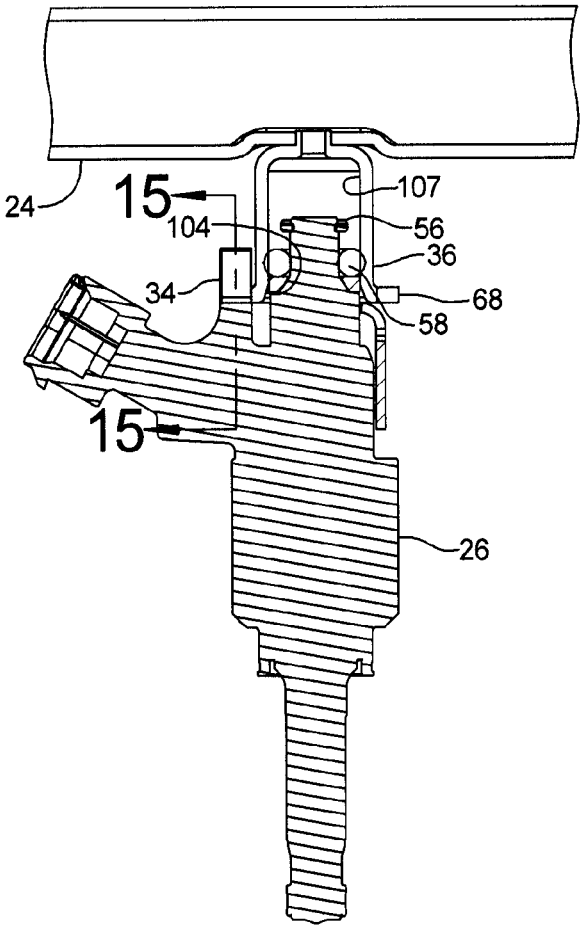
FIG. 14 is a cross sectional view of the fuel injector, fuel injector cup and fuel injector alignment tab in accordance with the present disclosure.
Figure 15:
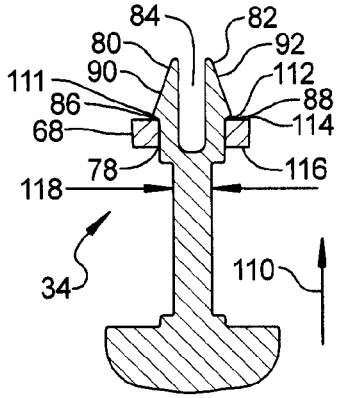
FIG. 15 is a cross sectional view of the fuel injector alignment tab relative to the fuel injector cup.

Turning now to FIGS. 14 and 15, FIG. 14 depicts injector inlet 56 of injector 26 protruding deeper or farther within fuel injector cup 36 compared to FIG. 12. In FIG. 14, O-ring 58 contacts interior wall 107 of fuel injector cup 36 and is located beyond or deeper than flange 68. When injector 26 is in the position depicted in FIG. 14, fuel injector alignment tab 34 is at the position depicted in FIG. 15. Thus, first and second alignment prongs 80, 82 of fuel injector alignment tab 34 have been compressed toward each other by contact with flange 68 and forced deeper into or through notch 74 in flange 68 of fuel injector cup 36. First alignment prong 80 has an apex 111 while second alignment prong 82 has an apex 112. Apex 111 is the juncture of surface 86 and surface 90 of prong 80, and apex 112 is the juncture of surface 88 and surface 92 of prong 82. Upon insertion, when apexes 111, 112 moving completely through notch 74, prongs 80, 82 become locked to a degree and will require a force to remove that is greater than the force of insertion.

As depicted in FIG. 15, prongs 80, 82 have moved through notch 74 to the extend that apexes 110, 112 are on a flange top side 114 as opposed to their position in FIGS. 11 and 13 when apexes 110, 112 are on a flange bottom side 116. Thus, when apexes 110, 112 are on a top side 114 of flange 68, prongs 80, 82 are again relaxed and not under a bending stress as none of surfaces 86, 88, 90, 92 are in contact with flange 68. When fuel injector 26 and more specifically, prongs 80, 82 are positioned as depicted in FIG. 15, fuel injector 26 is secured to fuel injector cup 36 and fuel rail 24 and thus injector 26 may not easily become dislodged or disconnected from fuel injector cup 36 during shipping and also fuel injector 26 may not become misaligned with fuel injector cup 36 or fuel rail 24 because fuel injector alignment tab 34 also aligns longitudinal axis of injector 26 with fuel rail 24. Longitudinal axis 70 of fuel injector 26 may be aligned (e.g. perpendicularly) with longitudinal axis of fuel rail 24 since a width 118 of tab head 78, which is parallel to movement direction of prongs 80, 82, has a close tolerance with width of notch 74. That is, tab head 78 has a width 118 nearly equal to that of width of notch 74. Although FIG. 15 depicts a location of fuel injector alignment tab 34 relative to flange 68 such that fuel injector alignment tab 34 will not easily pass back through alignment tab 34, because prong gap 84 is still within notch 74, prongs 80, 82 may still be susceptible to compression toward each other, or movement in general if force is applied to injector 26 or fuel rail 24.

Figure 16:
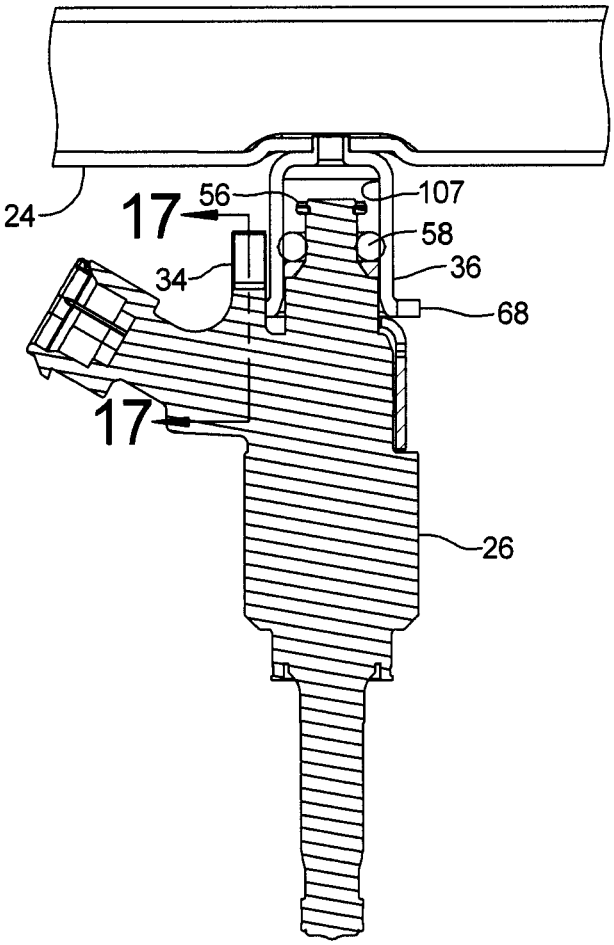
FIG. 16 is a cross sectional view of the fuel injector, fuel injector cup and fuel injector alignment tab in accordance with the present disclosure.
Figure 17:
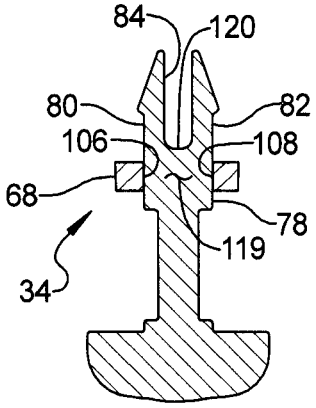
FIG. 17 is a cross sectional view of the fuel injector alignment tab relative to the fuel injector cup.

FIGS. 16 and 17 depict yet another position of fuel injector alignment tab 34 relative to flange 68 of fuel injector cup 36. More specifically, fuel injector alignment tab 34 may be positioned such that an entirely solid portion 119 of tab head 78 lies within notch 74 of flange 68. That is, base 120 of FIG. 17 is a non-linear or curved portion defining prong gap 84, is not located within notch 74 of flange 68. After installing or inserting fuel injector alignment tab 34 through notch 74, as depicted in FIG. 17, no force is exerted on prongs 80, 82 since prongs 80, 82 are located above or outside of notch 74. Thus, combined with an interference fit or a close tolerance fit of solid portion 119 of tab head 78 and flange sidewalls 106, 108, non-movement of prongs 80, 82 may be ensured. With non-movement of prongs 80, 82 with at least an interference fit or a close tolerance fit between solid portion 119 of tab head 78 and flange sidewalls 106, 108, alignment of injector tip 56 with fuel rail 24 may also be ensured. Additionally, to further reduce or prevent any side to side motion or movement of injector 26 within fuel injector cup 36, O-ring 58 compresses against cup interior sidewall 107 in an interference fit, as depicted in FIGS. 12, 14 and 16.

The teachings of the present disclosure reveal numerous advantages. An advantage is that O-ring 58 will be uniformly compressed within fuel injector cup 36 because of fuel injector alignment tab 34, which prevents inserting fuel injector 26 into fuel injector cup 36 in an angled manner. Thus, the longitudinal axis of fuel injector cup 36 and longitudinal axis of injector 26 will always coincide. Another advantage is that fuel injector alignment tab 34 is an integral part of fuel injector 26 as opposed to a separate piece. By integrating fuel injector 26 and fuel injector alignment tab 34 by overmolding, for example, separate pieces and additional fasteners are not necessary. Yet another advantage is that the force necessary to install and remove fuel injector alignment tab 34 from flange 68 of fuel injector cup 36 are different. The force required for installation is less than the force required for removal of the fuel injector alignment tab 34.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fuel injector apparatus comprising:

a fuel injector;

a fuel injector cup having a flange that defines a notch; and a tab integral with the fuel injector, the tab extending in an axial direction to attach the fuel injector to the cup, the tab having a first prong, a second prong and a gap disposed between the first prong and the second prong; wherein when the tab is attached to the fuel injector cup, a surface of the first prong and a surface of the second prong of the tab engages a surface of the fuel injector cup to prevent axial movement of the fuel injector with respect to the fuel injector cup;

the attachment of the tab to the fuel injector cup prevents rotational movement of the fuel injector with respect to the cup;

the first prong and the second prong of the tab protrude through the notch to secure the tab to the flange;

the first prong defining a first entry contact surface having a first specified insertion angle with respect to the axial direction to control an amount of force required to insert the tab into the notch;

the first prong defining a first exit contact surface having a first specified removal angle with respect to the axial direction to control an amount of force required to remove the tab from the notch, the first exit contact surface and the first entry contact surface are angled in opposite directions;

the second prong defining a second entry contact surface having a second specified insertion angle with respect to the axial direction to control an amount of force required to insert the tab into the notch;

the second prong defining a second exit contact surface having a second specified removal angle with respect to the axial direction to control an amount of force required to remove the tab from the notch, the second exit contact surface and the second entry contact surface are angled in opposite directions; and the first and second specified removal angles are larger than the first and second specified insertion angles, respectively, such that the amount of force required to insert the tab into the notch is less than the amount of force required to remove the tab from the notch.

2. The apparatus of claim 1, the first prong further comprising:

a first prong interior straight wall surface that faces the gap, the second prong further comprising:

a second prong interior straight wall surface that faces the gap, wherein the first prong interior straight wall surface and the second prong interior straight wall surface are parallel.

3. The apparatus of claim 1, wherein the first entry contact surface and the first exit contact surface meet.

4. The apparatus of claim 3, wherein the second entry contact surface and the second exit contact surface meet.

5. The apparatus of claim 4, wherein the tab defines a solid head portion below the gap, the solid head portion bounded by a first outside wall and a second outside wall.

6. The apparatus of claim 5, wherein the first outside wall has a first sidewall surface and the second outside wall has a second sidewall surface, wherein the first sidewall surface and the second sidewall surface are parallel.

7. The apparatus of claim 1, wherein no portion of the gap between the first prong and the second prong is disposed within the notch when the tab is fully attached to the fuel injector cup.

8. A fuel injector apparatus comprising:

a fuel injector;

a tab integral with the fuel injector, the tab further comprising a first prong, a second prong and a gap disposed between the first prong and the second prong; and a fuel injector cup that defines a notch through which the first prong and the second prong pass; wherein when the first and second prongs pass through the notch in an axial direction, a surface of the tab engages a surface of the fuel injector cup to prevent axial movement of the fuel injector with respect to the fuel injector cup;

when the first and second prongs pass through the notch, rotational movement of the fuel injector with respect to the cup is prevented; and the first prong defining a first entry contact surface having a first specified insertion angle with respect to the axial direction to control an amount of force required to insert the tab into the notch;

the first prong defining a first exit contact surface having a first specified removal angle with respect to the axial direction to control an amount of force required to remove the tab from the notch, the first exit contact surface and the first entry contact surface are angled in opposite directions;

the second prong defining a second entry contact surface having a second specified insertion angle with respect to the axial direction to control an amount of force required to insert the tab into the notch;

the second prong defining a second exit contact surface having a second specified removal angle with respect to the axial direction to control an amount of force required to remove the tab from the notch, the second exit contact surface and the second entry contact surface are angled in opposite directions; and the first and second specified removal angles are larger than the first and second specified insertion angles, respectively, such that the amount of force required to insert the tab into the notch is less than the amount of force required to remove the tab from the notch.

9. The apparatus of claim 8, the first prong further comprising:

a first prong interior straight wall surface that faces the gap, the second prong further comprising:

a second prong interior straight wall surface that faces the gap, wherein the first prong interior straight wall surface and the second prong interior straight wall surface are parallel and define a gap therebetween.

10. The apparatus of claim 8, wherein the tab defines a solid head portion below the entire gap, the solid head portion bounded by a first outside wall and a second outside wall.

11. The apparatus of claim 10, wherein the prongs are flexible to accommodate passage through the notch, and the solid head portion lies within the notch.

12. The apparatus of claim 8, wherein no portion of the gap between the first prong and the second prong is disposed within the notch when the tab is fully attached to the fuel injector cup.

13. A fuel injector apparatus comprising:

a fuel injector;

a tab integral with the fuel injector, the tab further comprising:

a solid head portion from which a first flexible prong and a second flexible prong protrude in an axial direction, together the first and second flexible prongs defining a gap disposed between the first and second flexible prongs; and a fuel injector cup that defines a notch through which the first flexible prong and the second flexible prong reside to secure the fuel injector to the fuel injector cup; wherein when the first and second prongs reside within the notch, a surface of the tab engages a surface of the fuel injector cup to prevent axial movement of the fuel injector with respect to the fuel injector cup;

when the first and second prongs reside within the notch, rotational movement of the fuel injector with respect to the cup is prevented; and the first flexible prong defining a first entry contact surface having a first specified insertion angle with respect to the axial direction to control an amount of force required to insert the tab into the notch;

the first flexible prong defining a first exit contact surface having a first specified removal angle with respect to the axial direction to control an amount of force required to remove the tab from the notch, the first exit contact surface and the first entry contact surface are angled in opposite directions;

the second flexible prong defining a second entry contact surface having a second specified insertion angle with respect to the axial direction to control an amount of force required to insert the tab into the notch;

the second flexible prong defining a second exit contact surface having a second specified removal angle with respect to the axial direction to control an amount of force required to remove the tab from the notch, the second exit contact surface and the second entry contact surface are angled in opposite directions; and the first and second specified removal angles are larger than the first and second specified insertion angles, respectively, such that the amount of force required to insert the tab into the notch is less than the amount of force required to remove the tab from the notch.

14. The apparatus of claim 13, the first prong further comprising:

a first prong interior straight wall surface that faces the gap, the second prong further comprising:

a second prong interior straight wall surface that faces the gap, wherein the first prong interior straight wall surface and the second prong interior straight wall surface are parallel.

15. The apparatus of claim 13, wherein the tab defines a solid head portion below the entire gap, the solid head portion capable of passing through the notch.

16. The apparatus of claim 15, further comprising:

a non-linear base point defined at a portion of the tab where a non-linear portion of the first prong interior straight wall surface and a non-linear portion of the second prong interior straight wall surface meet.

17. The apparatus of claim 16, further comprising a fuel injection common rail, wherein the cup defines a flange and the notch resides in the flange, the flange having a top surface that faces the fuel injection common rail and a bottom surface that faces away from the fuel injection common rail, the non-linear base point resides between the fuel injection common rail and the top surface.

18. The apparatus of claim 16, further comprising a fuel injection common rail, wherein the cup defines a flange and the notch resides in the flange, the flange having a top surface that faces the fuel injection common rail and a bottom surface that faces away from the fuel injection common rail, the non-linear base point resides between the bottom surface and the fuel injection common rail.

19. The apparatus of claim 13, wherein no portion of the gap between the first prong and the second prong is disposed within the notch when the tab is fully attached to the fuel injector cup.

* * * * *